United States Patent [19]

Rudick

[11] Patent Number: 4,970,871

[45] Date of Patent: Nov. 20, 1990

[54] CARBONATOR REFRIGERATION SYSTEM

[75] Inventor: Arthur G. Rudick, Marietta, Ga.

[73] Assignee: The Coca-Cola Company, Atlanta, Ga.

[21] Appl. No.: 366,536

[22] Filed: Jun. 15, 1989

[51] Int. Cl.[5] ..... F25D 17/04

[52] U.S. Cl. ..... 62/187; 62/338; 62/389; 62/393; 62/407; 62/448; 222/146.6

[58] Field of Search ..... 62/394, 395, 389, 393, 62/338, 337, 448, 386, 407, 408, 186, 187; 222/146.6

[56] References Cited

U.S. PATENT DOCUMENTS

| | | | |
|---|---|---|---|
| 1,501,874 | 7/1924 | Wardenburg | 62/187 X |
| 2,474,499 | 6/1949 | Spoonhour | 62/187 X |
| 2,572,715 | 10/1951 | Gallaugher | 62/187 |
| 2,894,377 | 7/1959 | Shikles, Jr. et al. . | |
| 3,021,685 | 2/1962 | Gore et al. | 62/89 |
| 3,834,178 | 9/1974 | Pink | 62/338 |
| 4,008,832 | 2/1977 | Rodth | 222/129.1 |
| 4,036,620 | 7/1977 | Benasutti | 62/338 |
| 4,440,318 | 4/1984 | Berger | 222/129.1 |
| 4,514,994 | 5/1985 | Mabb | 62/389 |
| 4,614,092 | 9/1986 | Kim et al. | 62/408 |
| 4,704,874 | 11/1987 | Thompson et al. | 62/187 |
| 4,866,949 | 9/1989 | Rudick | 62/393 X |

*Primary Examiner*—Lloyd L. King

[57] ABSTRACT

A carbonator refrigeration system for use in a conventional refrigerator for dispensing a chilled carbonated liquid such as water or a beverage from the front door of the refrigerator. The system includes a compressor, an evaporator, a condenser, a carbonator and a valve member wherein the valve member is responsive to conditions detected within the refrigerator for selectively directing a source of cooling fluid to or away from a heat exchange device provided in connection with the carbonator. The carbonator refrigeration system enables cooling of the carbonator for home dispensing use in a time-share manner with the remaining mechanical refrigeration components.

25 Claims, 5 Drawing Sheets

CARBONATOR REFRIGERATION SYSTEM

BACKGROUND OF THE INVENTION

Field of the Invention

The present invention relates generally to a refrigeration apparatus for home refrigerator-freezer units and more particularly to a refrigeration system for the carbonator apparatus of a post-mix beverage dispenser mountable in a conventional home refrigerator.

In recent years, home refrigerators have been designed to dispense chilled products such as ice, water and beverages through the front door of the refrigerator when the door is closed. Not only is this a convenience to the homeowner, but it also acts to save energy by reducing the number of times that the refrigerator door must be opened and closed. Home refrigerator dispensing systems accessible by opening the door are also useful to the homeowner if adequate product cooling can be maintained.

Both types of systems have a need for easily and efficiently cooling a carbonator used within the refrigerator dispensing system which will time-share the refrigerator's existing cooling system so that additional auxiliary refrigeration systems will not be required. The use of the existing refrigeration system for cooling the carbonator should, further, be effective regardless of the location of the carbonator within the refrigerator door or the interior of the refrigerator.

To be effective and useful, any beverage dispensing system for use in a home refrigerator should be simple so that it can be easily built into or retrofitted into the refrigerator.

SUMMARY OF THE INVENTION

Accordingly, it is the primary object of the invention to provide an improvement in liquid dispensing systems for conventional home refrigerators.

It is another object of the present invention to provide a carbonated liquid dispenser integral with a conventional home refrigerator.

It is a further object of the present invention to provide a system for dispensing a chilled carbonated liquid from a door on the front of the refrigerator.

It is a still further object of the present invention to cool the carbonator used in the dispensing system by time-sharing the existing refrigeration system.

These and other objects of the present invention are fulfilled by providing an apparatus in a home refrigerator for dispensing a chilled carbonated liquid, said refrigerator having a mechanical refrigeration system including a compressor an evaporator and a condenser, the improvement comprising:

(a) a source of cooling fluid flowing across the evaporator;

(b) a carbonator device disposed in said cabinet;

(c) heat exchange means, provided in association with said carbonator device, for cooling said carbonator device;

(d) conduit means for connecting said source of cooling fluid in fluid communication with said heat exchange means;

(e) sensor means for detecting temperature related parameters of the carbonator device;

(f) valve means for selectively regulating the flow of said cooling fluid to said heat exchange means; and (g) control means for operating said valve means in response to the temperature related parameters detected by said sensor means.

The cooling fluid may be either chilled air passing over the evaporator, or a high pressure refrigerant passing through the evaporator in route to the carbonator.

BRIEF DESCRIPTION OF THE DRAWINGS

The objects of the present invention and the attendant advantages thereof will become more readily apparent by reference to the accompanying drawings, wherein.

DETAILED DESCRIPTION OF THE PREFERRED EMBODIMENTS

Figure 1:
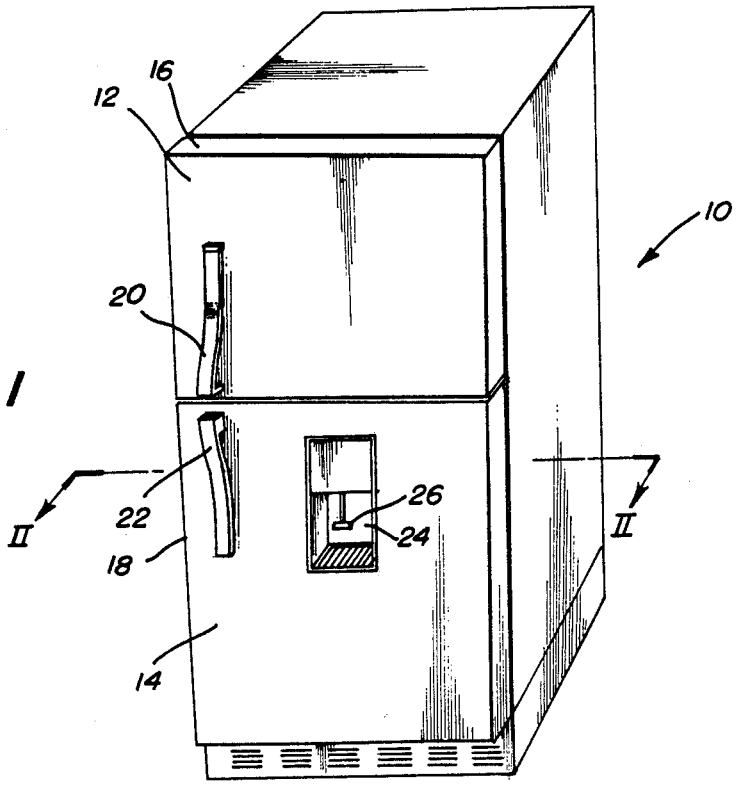
FIG. 1 is a front perspective view generally illustrative of a conventional refrigerator having an upper freezer compartment and a lower refrigeration compartment.

Referring now to the drawings wherein like reference numerals refer to like parts throughout, attention is directed first to FIG. 1 where reference numeral 10 denotes a conventional home refrigerator of the type which is comprised of an upper freezer compartment 12 and a lower refrigeration compartment 14, which includes respective handles 20 and 22 for opening the doors.

The present invention has the capability of dispensing carbonated water or a post-mix carbonated beverage including a mixture of flavor concentrate 28 and carbonated water from one of the front doors of a home refrigerator. This may be done through the lower door 14 which includes a generally rectangular access opening or recess 24 wherein a liquid receptacle (not shown) can be inserted therein and pressed against an actuation lever 26 coupled to a liquid dispenser having a discharge port (not shown).

Figure 2:
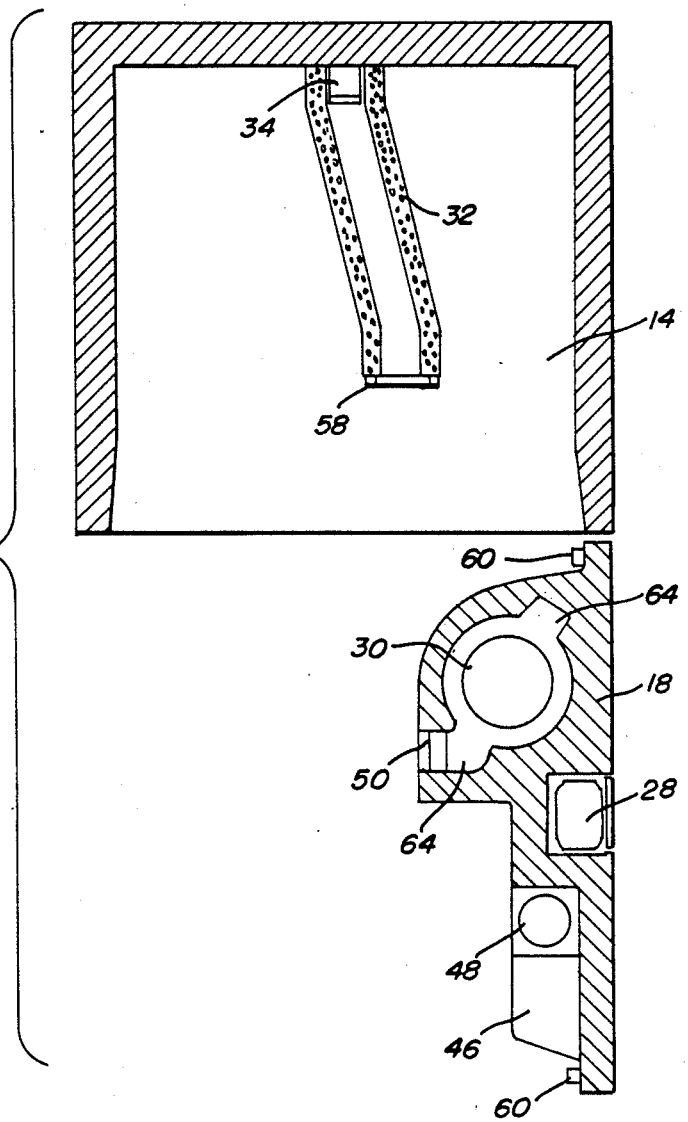
FIG. 2 is a top plan view taken along lines II—II of FIG. 1 with the refrigerator door in an opened position and is illustrative of one embodiment of the present invention.

Referring now to FIG. 2, there is shown the details of the first embodiment of the present invention wherein an entire dispensing system including the carbonator 30 located in the refrigerator door which is in an opened position.

Figure 3:
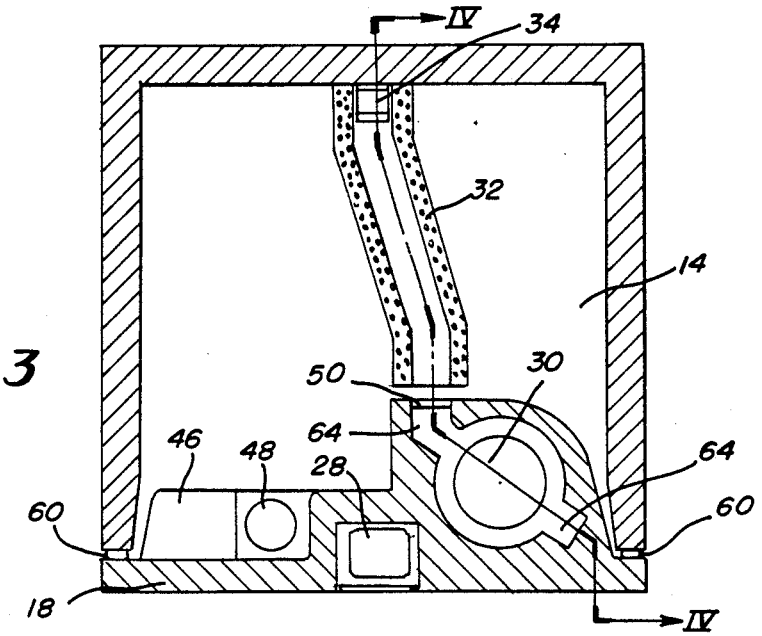
FIG. 3 is a top plan view taken along lines II—II of FIG. 1 with the refrigerator door in a closed position.

FIG. 3 is a view similar to that of FIG. 2, but with the refrigerator door 18 in a closed position.

With respect to FIGS. 2 and 3, there is shown, in addition to the carbonator 30 in the refrigerator door 18, a $CO_2$ cylinder 48 and a control section 46 positioned adjacent each other in the refrigerator door 18.

The syrup package 28 is centrally located in the refrigerator door 18 above a dispensing outlet in an opening or recess 24. Door seals 60 assist in sealing the interior of the refrigerator 14 from external atmosphere and, although shown in cross-section, run the entire vertical length of the door 18 between the door and the refrigerator.

Figure 4:
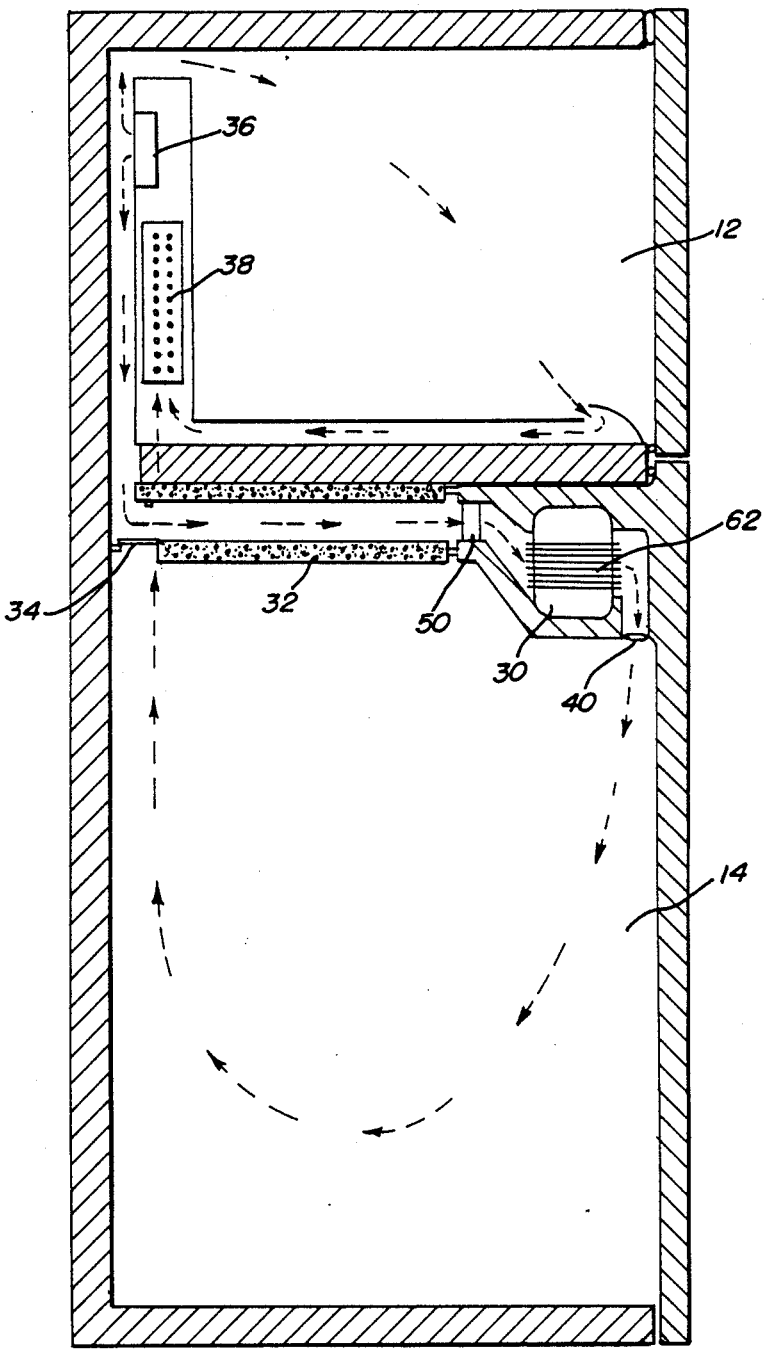
FIG. 4 is a front cross-sectional view taken along lines IV—IV of FIG. 3.

The carbonator 30 is surrounded by a band of heat transfer fins 62 which are enclosed within a torroidal plenum 64 (see FIG. 4).

An insulated duct 32 within the refrigerator compartment 14 includes a carbonator by-pass valve 34 and a duct seal 58.

Referring now to FIG. 4 which is a front cross-sectional view taken along lines IV—IV in FIG. 3, it can be seen that within the freezer compartment 12 there is positioned a freezer fan 36 and an evaporator 38 adjacent the rear of freezer compartment 12.

The arrangement described enables a unique ability to cool the carbonator 30 with the use of the existing refrigeration elements, including the evaporator 38 (more clearly shown in FIG. 5), and a compressor and condenser disposed below the cabinet.

In order to cool the carbonator, cold air from the evaporator 38 flows past a closed carbonator by-pass valve 34 through the insulated duct 32, through a booster or carbonator fan 50, through the heat transfer fins 62 surrounding the carbonator 30, and then through a short exhaust duct 40 into the interior of the refrigerator 14.

Thus the carbonator by-pass valve 34 is in the closed position, the cold air from evaporator 38 is directed to the carbonator 30. When the by-pass valve 34 is in an open position, the cold air generated by evaporator 38 is directed straight into the refrigerator compartment 14, as it would be in a conventional refrigerator. An ice bank detector (see FIG. 8) located in controls 46 determines the position of the by-pass valve 34 such that when the ice bank detector senses a lack of an adequate ice bank surrounding the carbonator, a control system 46 will switch closed the bypass in order to direct evaporator-cooled air directly at the carbonator 30 as shown in FIG. 4. A conventional ice bank detector is disclosed, for example, in U.S. Pat. No. 4,008,832 to Rodth entitled "Three Drink Gravity Dispenser for Cool Beverages " and is incorporated herein by reference. Whether or not the compressor 44 is running is determined by the set point of the interior of the refrigerator as detected by a temperature sensor associated with controls 46. The temperature sensor may be located in any suitable location within the refrigerator.

Water and electricity are routed to the refrigerator door 18 by flexible connectors in the hinge area (not shown). When the refrigerator door 18 is opened (see FIG. 2), the carbonator 30 and its related assembly swings awaY from the insulated duct 32. When the refrigerator door 18 is closed (see FIG. 3), the carbonator 30 and its related assembly reconnects to the insulated duct 32.

Figure 7:
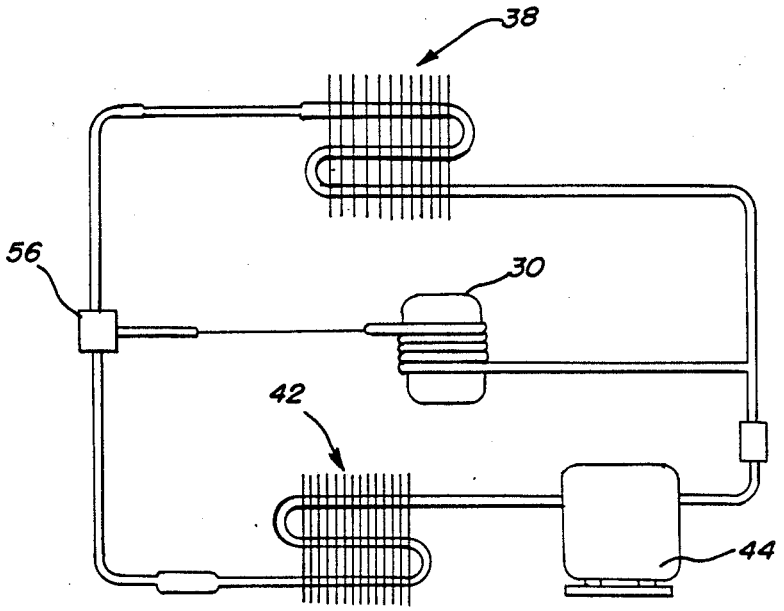
FIG. 7 is a schematic view of a third embodiment of a refrigeration system the present invention.
Figure 5:
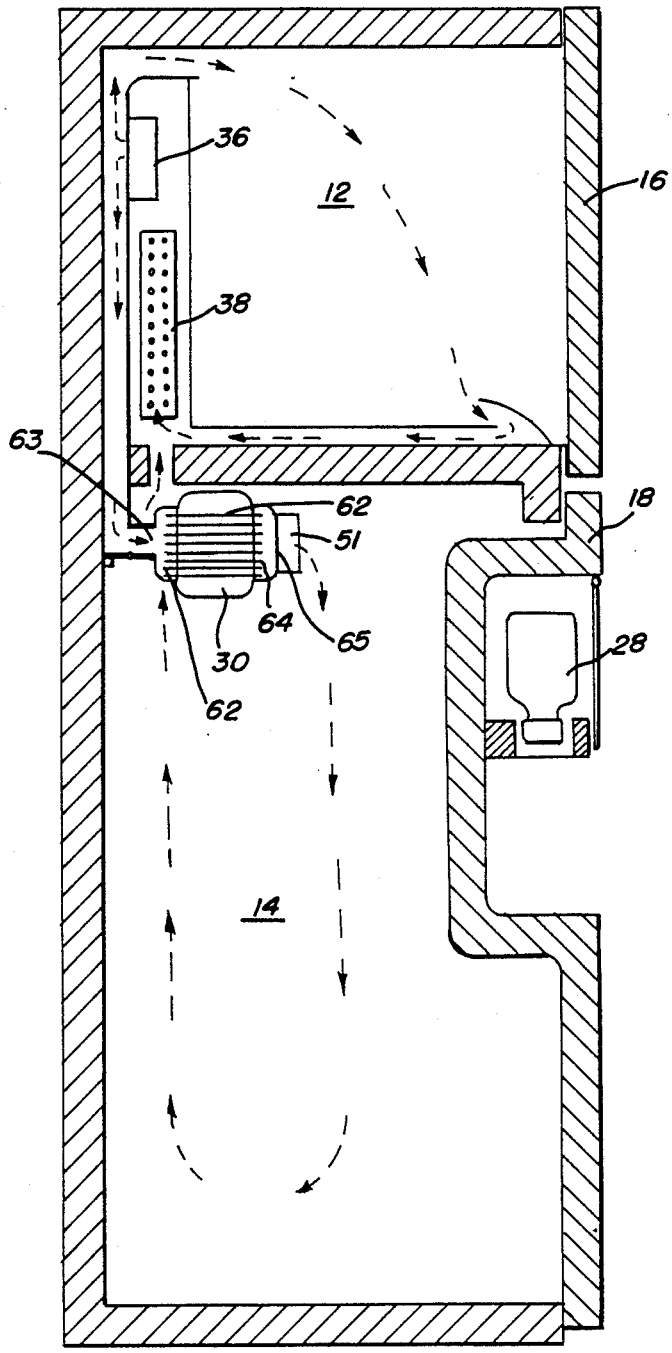
FIG. 5 is a front cross-sectional view of a second preferred embodiment of the present invention with a carbonator by-pass valve in a closed position.
Figure 6:
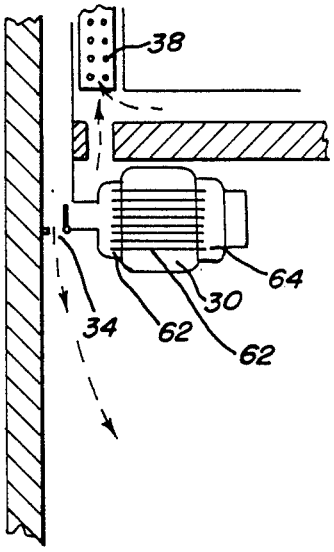
FIG. 6 is a partial cross-sectional view of the embodiment shown in FIG. 5 with the carbonator by-pass valve in an opened position.

FIG. 5 is a front cross-sectional view of a second preferred embodiment of the present invention, showing the carbonator by-pass valve 34 in a closed position. FIG. 7 is a partial cross-sectional view of FIG. 6 showing the carbonator by-pass valve 34 in an opened position.

Similar to the first embodiment shown, the second embodiment uses the refrigerator's main refrigeration system with no additional auxilliary refrigeration systems.

The carbonator 30 is likewise surrounded by a band of heat transfer fins 62 which are enclosed within a torroidal plenum 64.

In a carbonator cooling operation, cold air from the evaporator 38 is ducted past a closed carbonator by-pass valve 34, into the plenum inlet 63, over the carbonator's heat transfer fins 64 and then through the plenum outlet 65 into the refrigeration compartment 14. If the heat transfer fins 62 cause too much resistance to the air flow, an exhaust fan 51 for the carbonator 30 can be added to the plenum outlet 65.

Thus, when the by-pass valve 34 is in the closed position, the cold air from the evaporator 38 is directed to the carbonator 30 prior to passing into the refrigerator compartment 14. When the by-pass valve 34 is in the open position, the cold a-r is directed straight into the refrigeration compartment 14, as it would be in a conventional refrigerator. The ice bank detector (see FIG. 8) determines the position of the by-pass valve 34 such that when the ice bank detector senses a lack of an adequate ice bank surrounding the carbonator, a control system 46 will switch closed the bypass valve 34 in order to direct evaporator-cooled air directly at the carbonator 30 as shown in FIG. 5. Whether or not compressor under the refrigerator (not shown in FIGS. 6 and 7) is running is determined by the set point of a temperature sensor in the interior of the refrigerator.

Similar to the first embodiment, carbonated water from the carbonator 30 is directed to a dispensing mechanism in door 18 by way of a flexible tube routed through the hinge area (not shown).

Referring now to FIG. 7, there is shown a schematic view for a substitute refrigeration system for use as a third embodiment of the present invention. The system schematically shown provides an evaporator 38 which cools the interior of both the freezer 12 and the refrigerator 14. When the ice bank detector senses the presence of an adequate ice bank of more than a predetermined thickness on the carbonator 30, a three-way valve 56 will always direct a high pressure refrigerant to the evaporator 38, by-passing the carbonator 30. When the ice bank detector senses a lack of an adequate ice bank on the carbonator 30, a control system 46 will oscillate the three-way valve 56 back and forth, sending high pressure refrigerant to the carbonator's cooling coils 62 for an appropriate percentage of the compressor 44 run cycle, and send high pressure refrigerant to the evaporator 38 for the remainder of the run cycle in the compressor 44.

It should be understood that the mechanical refrigeration system used with the first and second embodiments of FIGS. 4 and 5 of FIG. 7 includes evaporator 38, condenser 42 and compressor 44. However, valve 56 and coil 62 would not be included in those embodiments.

Figure 8:
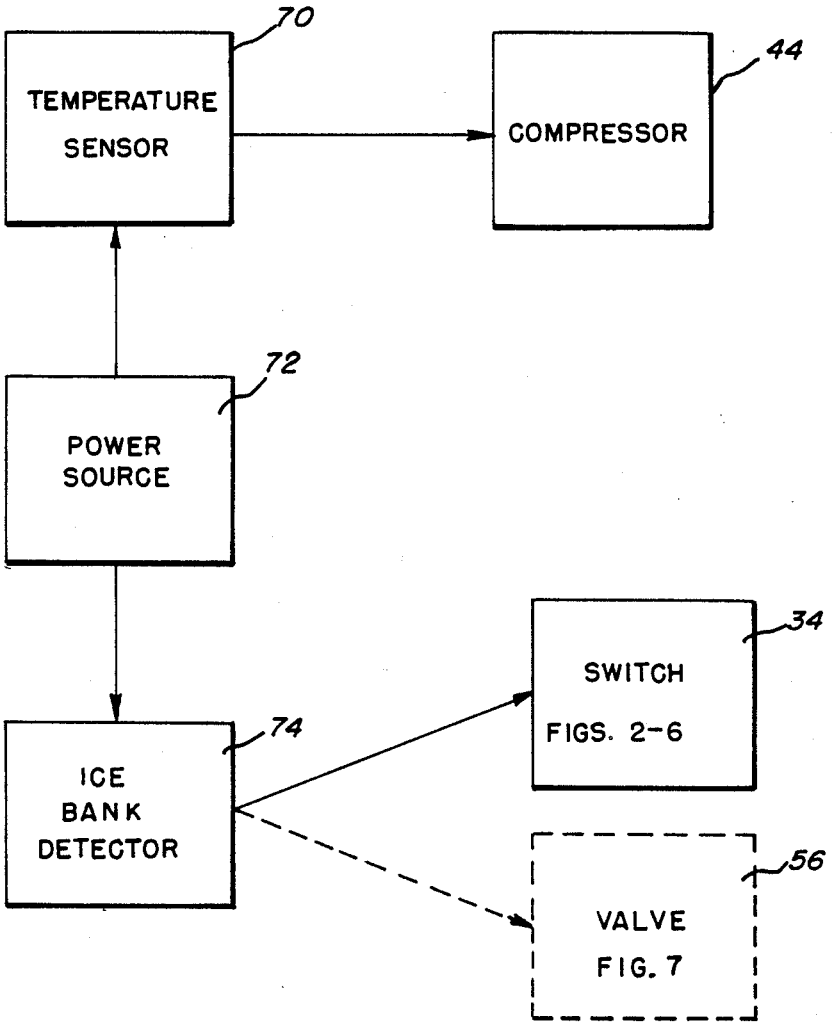
FIG. 8 is a block diagram showing only the essential control components for the carbonator refrigeration system in each of the embodiments of the present invention.

Referring now to FIG. 8, there is shown a block diagram of the essential control components for the carbonator refrigeration system in each of the embodiments of the present invention.

In particular, it can be seen that a temperature sensor 70 is primarily responsible for detecting the temperature within the interior of the refrigerator. The interior temperature of the refrigerator is to be maintained at a predetermined set point, such that when the temperature falls below the predetermined set point, the compressor 44 is activated to initiate cooling by evaporator 38 (see FIG. 7).

Power source 72 can be any suitable power means available for running a standard refrigerator.

The ice bank detector 74 detects the lack of an adequate ice bank (below a predetermined thickness) surrounding the carbonator 30 such that detection of an adequate ice bank will operate to open switch 34 and allow chilled air to pass directed into the refrigerator compartment 14. Conversely, if an inadequate ice bank is detected, the switch 34 will close allowing chilled air to cool the carbonator 30.

If high pressure refrigerant is being utilized to cool the carbonator, the three-way valve 56 operates as described in connection with FIG. 7 whereby when the ice bank detector senses the presence of an adequate ice bank on carbonator 30, the three-way valve 56 will always direct the high pressure refrigerant to the evaporator 38, by-passing the carbonator 30. When the ice bank detector 74 senses a lack of an adequate ice bank on the carbonator 30, the three-way valve 56 will oscillate to direct high pressure refrigerant to the carbonator cooling coils 62 for an appropriate percentage of the compressor 44 run cycle, and send high pressure refrigerant to the evaporator 38 for the remainder of the compressor 44 run cycle.

It should be understood that the foregoing detailed description has been made by way of illustration and not limitation. Accordingly, all such modifications, alterations and changes coming within the spirit and scope of the invention are herein meant to be included.

What is claimed is:

1. An apparatus for use in a refrigerator cabinet for dispensing a chilled carbonated liquid, said refrigerator having a mechanical refrigeration system including, an evaporator, a compressor and a condenser, the improvement comprising:

(a) a source of cooling fluid flowing across the evaporator;

(b) a carbonator device disposed in said cabinet;

(c) heat exchange means, provided in association with said carbonator device, for cooling said carbonator device;

(d) conduit means for connecting said source of cooling fluid in fluid communication with said heat exchange means;

(e) sensor means for detecting temperature related parameters of the carbonator device;

(f) valve means for selectively regulating the flow of said cooling fluid to said heat exchange means; and (g) control means for operating said valve means in response to the temperature related parameters detected by said sensor means.

2. The apparatus according to claim 1, wherein said valve means selectively directs said cooling fluid in a first direction toward said heat exchange means and in a second direction to direct cooling fluid to the interior of said refrigerator away from said carbonator device.

3. The apparatus according to claim 1, wherein said cooling fluid is chilled air which passes across said evaporator.

4. The apparatus according to claim 3 wherein said heat exchange means comprises cooling fins surrounding said carbonator device.

5. The apparatus of claim 1, wherein said cooling fluid is a high pressure cooling refrigerant which passes through said evaporator.

6. The apparatus of claim 5 wherein said heat exchange means comprises a coil surrounding said carbonator device in fluid communication with said conduit means.

7. The apparatus according to claim 4, wherein said cooling fins are enclosed within a plenum, said plenum having an inlet connected to said conduit means and an outlet for directing the flow of chilled air across said carbonator.

8. An apparatus for use in a refrigerator cabinet for dispensing a chilled carbonated liquid, said refrigerator cabinet having a freezer compartment and a refrigeration compartment, an evaporator for generating chilled air within the freezer compartment and at least one external door mounted on the refrigerator cabinet, comprising:

a carbonator mountable within said refrigeration compartment;

an air duct for feeding said chilled air from said evaporator to said carbonator;

sensor means for detecting temperature related parameters of said carbonator;

valve means for regulating the flow of chilled air through the air duct; and control means for operating said valve means in response to the temperature related parameters detected by said sensor means.

9. The apparatus according to claim 8, wherein said air duct includes an inlet end in fluid communication with said valve means and an outlet end in fluid communication with said carbonator.

10. The apparatus according to claim 8, wherein said carbonator includes heat transfer fins thereon enclosed within a plenum, said plenum having an inlet connected to the outlet end of the air duct and an outlet for directing the flow of said chilled air across said carbonator into the refrigeration compartment.

11. The apparatus according to claim 8, wherein said valve means is selectively operable between an open position and a closed position to start or stop the flow of chilled air through said air duct, respectively, one of, said positions enabling the flow of chilled air from said evaporator directly into said refrigeration compartment, the other of said positions enabling the flow of chilled air from said evaporator through said air duct to said carbonator.

12. The apparatus according to claim 8, further including an evaporator fan for assisting the flow of chilled air generated by said evaporator to either selected the carbonator or refrigeration compartment.

13. The apparatus according to claim 9, further including a booster fan positioned at the outlet end of said air duct for assisting the flow of chilled air generated by said evaporator past said carbonator.

14. The apparatus according to claim 10, wherein said outlet of said plenum includes an exhaust duct for directing the flow of chilled air into said refrigeration compartment.

15. The apparatus according to claim 10, wherein the carbonator is mounted on the door and said inlet of said plenum mates with the outlet of said air duct when the door is closed and wherein the inlet of said plenum is spaced apart from the outlet of said air duct when the refrigerator door is opened.

16. An apparatus for use in a refrigerator cabinet for dispensing a chilled carbonated liquid, said refrigerator cabinet having a freezer compartment and a refrigeration compartment, an evaporator for generating chilled air disposed within the freezer compartment and at least one external door mounted on the refrigerator cabinet, comprising:

a carbonator mounted within said refrigeration compartment;

sensor means for detecting temperature related parameters of said carbonator;

valve means for regulating the flow of chilled air generated through regions surrounding said carbonator; and control means for operating said valve means in response to the temperature related parameters detected by said sensor means.

17. The apparatus, according the claim 16, wherein said valve means is selectively operable between an open position and a closed position to start or stop the flow of chilled air to the regions surrounding the carbonator, respectively, one of said positions enabling the flow of chilled air from said evaporator directly into said refrigeration compartment, the other of said positions enabling the flow of chilled air from said evaporator directly to regions surrounding said carbonator.

18. The apparatus according to claim 16, wherein said carbonator includes heat transfer fins enclosed within a plenum said plenum having an inlet in fluid communication with said valve means for directing the flow of said chilled air across said carbonator and an outlet for exhausting chilled air to the refrigeration compartment.

19. The apparatus according to claim 16, further including an evaporator fan for assisting the flow of chilled air generated by said evaporator to either of said carbonator or said refrigeration compartment.

20. The apparatus according to claim 18, wherein an exhaust fan for assisting in the dispersion of cooled air within said refrigeration compartment is disposed in fluid communication with the outlet of the plenum.

21. The apparatus of claim 1 wherein said sensor means includes temperature sensor means within the refrigerator cabinet for detecting the temperature in said cabinet as one of said temperature related parameters, said temperature sensor causing said control means to energize said compressor when the temperature sensed is below a predetermined value.

22. The apparatus of claim 21 wherein said sensor means includes means for detecting the thickness of an ice bank formed in said carbonator, said thickness being one of said temperature related parameters.

23. The apparatus of claim 1 wherein said sensor means includes means for detecting the thickness of an ice bank formed in said carbonator, said thickness being one of said temperature related parameters.

24. The apparatus of claim 8 wherein said sensor means includes means for detecting the thickness of an ice bank formed in said carbonator, said thickness being one of said temperature related parameters.

25. The apparatus of claim 16 wherein said sensor means includes means for detecting the thickness of an ice bank formed in said carbonator, said thickness being one of said temperature related parameters.

* * * * *